US005722585A

United States Patent [19]

Redl

[11] Patent Number: 5,722,585

[45] Date of Patent: Mar. 3, 1998

[54] FOLDING BOX WITH SELF-ADHESIVE SEAL

[75] Inventor: Hermann M. Redl, Justus-von-Liebig-Strasse 17, D-86899 Landsberg, Germany

[73] Assignee: Hermann M. Redl, Landsberg, Germany

[21] Appl. No.: 760,791

[22] Filed: Dec. 5, 1996

[30] Foreign Application Priority Data

Dec. 8, 1995 [DE] Germany ..... 295 19 492 U

[51] Int. Cl.[6] ..... B65D 5/66

[52] U.S. Cl. ..... 229/136; 53/376.5; 53/377.4; 53/491; 229/160

[58] Field of Search ..... 229/132, 136, 229/160, 160.2, 926; 53/416, 419, 491, 376.5, 377.4

[56] References Cited

U.S. PATENT DOCUMENTS

| | | | |
|---|---|---|---|
| 1,990,637 | 2/1935 | Daller | 229/136 |
| 2,063,999 | 12/1936 | Harrison | 229/136 |
| 2,675,165 | 4/1954 | Roshkind et al. | 229/160 |
| 2,678,153 | 5/1954 | Buttery | 229/160 |
| 2,998,180 | 8/1961 | Dehoney, Jr. | 229/136 |
| 3,130,895 | 4/1964 | Davis | 229/136 |
| 3,306,521 | 2/1967 | Giacovas . | |
| 3,877,630 | 4/1975 | Silver | 229/160 |
| 4,750,609 | 6/1988 | Felis . | |
| 4,848,589 | 7/1989 | Olson et al. | 229/136 |
| 5,065,935 | 11/1991 | Mancel | 229/136 |

FOREIGN PATENT DOCUMENTS

| | | | |
|---|---|---|---|
| 2649671 | 1/1991 | France | 229/136 |
| 1956078 | 1/1971 | Germany . | |
| 2143422 | 10/1972 | Germany . | |
| 4302886 A 1 | 8/1994 | Germany . | |

*Primary Examiner*—Gary E. Elkins
*Attorney, Agent, or Firm*—Murtha, Cullina, Richter & Pinney

[57] ABSTRACT

The invention relates to a folding box with self-adhesive seal and a method for sealing the folding box. The folding box has a cover (6) which can be locked in the sealing position at one of its free edges by a mechanical locking (10, 11), flaps (14, 15) that can be folded in under the cover, and contact adhesive strips (17) with covering strips (19) able to be pulled off, for gluing the cover (6) together with the flaps (14, 15). The covering strips (19) have at their free end a tab (19*a*) that protrudes from the closed folding box. By pulling on the tab (19*a*), the covering strips (19) can be pulled out laterally under the cover (6) locked in sealing position, in order to glue the cover (6) together with the flaps (14, 15). On perforated tear lines (23), the middle section of the cover (6) can be opened again, without having to undo the adhesive connection in doing so. In use, the box is closed by first bringing the cover into the sealing position and locking it mechanically in this position and then, by pulling out the covering strips, exposing the contact adhesive strips and gluing the cover down.

9 Claims, 3 Drawing Sheets

FOLDING BOX WITH SELF-ADHESIVE SEAL

FIELD OF THE INVENTION

The invention relates to a folding box of the type indicated in the introductory clause of claim 1. Folding boxes of this kind are known, for example, from German documents DE-GBM-72 08 095 and DE-A-42 26 226.

BACKGROUND OF THE INVENTION

A problem with such folding boxes consists in that in the folding lines of the cover and the flaps folded in under it, restoring forces are acting that subject the adhesive connection to strain and seek to undo it. To achieve a secure adhesion, the cover and the flaps must be pressed against each other with considerable expenditure of force, namely until a full-surface adhesion is achieved. The sealing process with such folding boxes is not as simple as it could be, because the flaps and the cover must be folded into the sealing position at the same time and held there, and the pressure necessary to produce the adhesive connection must be exerted on the adhesive areas.

A further disadvantage consists in that the adhesive strips must be exposed by pulling off the covering strips, before the cover is moved into the sealing position. In the process, the adhesive strips can easily get dirty or lose their adhesive ability through contact with oily fingers, for example. In addition, there is the danger that during the sealing process, an adhesion occurs already when the cover and/or the flaps are not yet in the exact, final sealing position. Besides, there is the problem that with conventional folding boxes it is possible, without tearing open the adhesive connection, to lift the cover high enough that a gap is formed through which one can look inside the box or even remove the contents.

SUMMARY OF THE INVENTION

The invention is based on the technical problem of improving a folding box of the aforementioned type in such a way that the fixing of the cover in the sealing position is improved, in doing so the folding box is sealed all around, and the process of sealing the box is simplified. The invention's solution to the technical problem is indicated in claim 1. The remaining claims indicate other preferred constructions.

With the folding box according to the invention, the processes of fixing the cover in the sealing position and producing the adhesive connection between the cover and the flaps are functionally separated in advantageous manner. The cover can first be closed and fixed in the sealing position by mechanical locking and then, with the box already closed, the covering strips can be pulled out laterally under the cover and in this way, the adhesive connection between the cover and the flaps can be produced.

Forms of construction of the invention are explained in greater detail with the help of the drawings.

DESCRIPTION OF PREFERRED EMBODIMENTS

Figure 1:
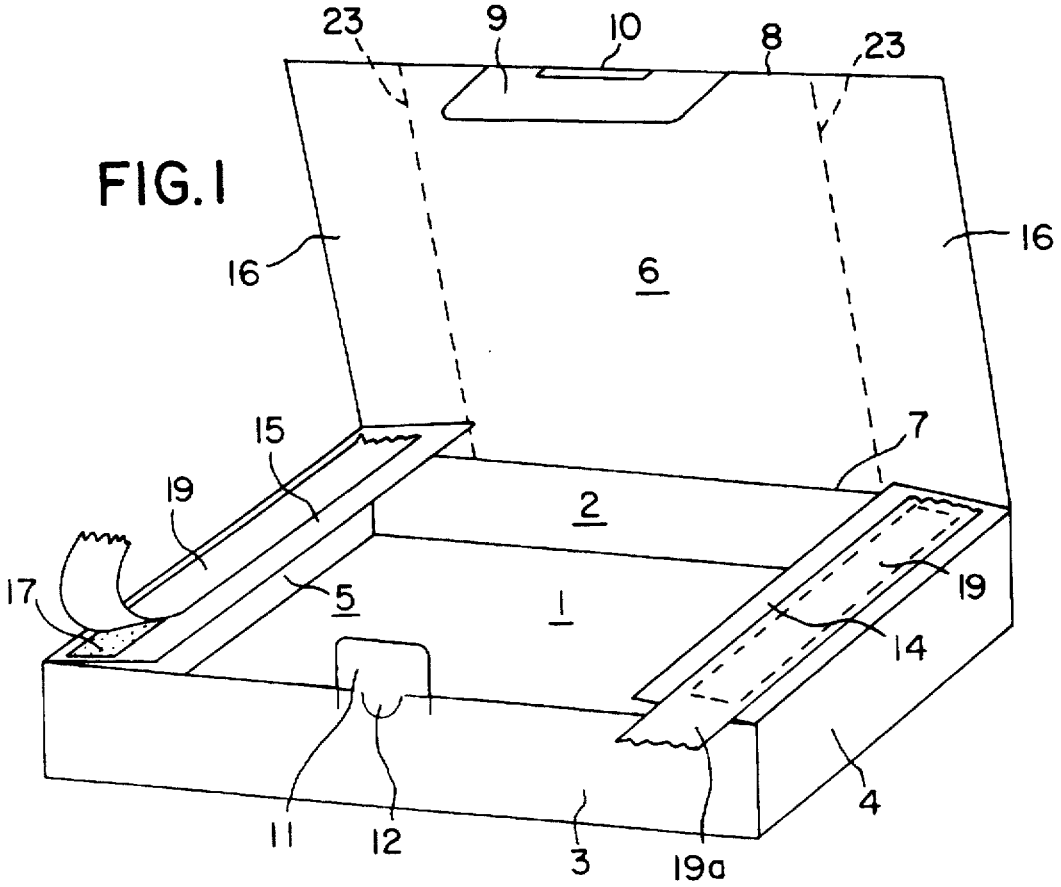
FIG. 1: in perspective, a folding box according to the invention, in open condition.
Figure 2:
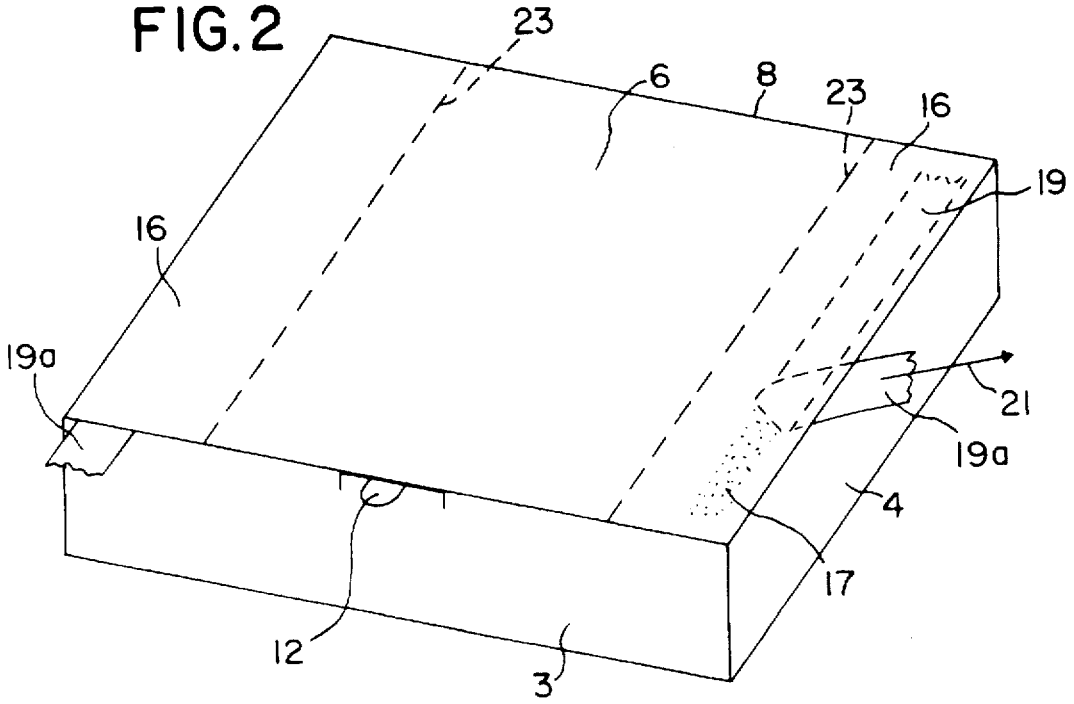
FIG. 2: the folding box in closed condition.

The folding box shown in FIGS. 1 and 2 has a bottom 1, side walls 2, 3, 4, 5 and a cover 6 that is connected via a folding line 7 with the rear side wall 2. At its free edge 8 parallel to the folding line 7, the cover 6 is provided with a 90° offset tongue 9 with a slit 10. A tongue 11 attached on the front side wall 3 can be inserted into the slit 10, in order to mechanically lock the cover 6 in the sealing position (FIG. 2). By means of a grip tab 12 protruding outward from the tongue 11, the tongue 11 can be pulled out of the slit 10 in order to undo the locking.

Provided on each of the side walls 4, 5 running at right angles to the folding line 7 of the cover 6 is a dust flap 14, 15 that can be folded in and which, when folded, is situated under the cover 6 and is overlapped by it. Each dust flap 14, 15 is provided, parallel to its folding edge, with an adhesive strip 17 which is covered with a cover strip 19 that can be easily pulled off. A tab 19*a* of each covering strip 19 projects forward over the front side wall 3.

To seal the folding box, at first the dust flaps 14, 15 are folded in, then the cover 6 is brought into the sealing position and is fastened by inserting the tongue 11 into the slit 10, in such a way that the condition according to FIG. 2 is achieved. Then, the covering strips' 19 tabs 19*a* projecting over the front side wall 3 can be grasped and the covering strips can be pulled out laterally under the cover 6, as indicated in FIG. 2 by the arrow 21. In this way, the contact adhesive strips 19 are exposed beneath the closed cover 6, and by pressure on the corresponding areas of the cover 6, these can be adhered together with the dust flaps 14, 15 situated underneath.

Figure 3A:
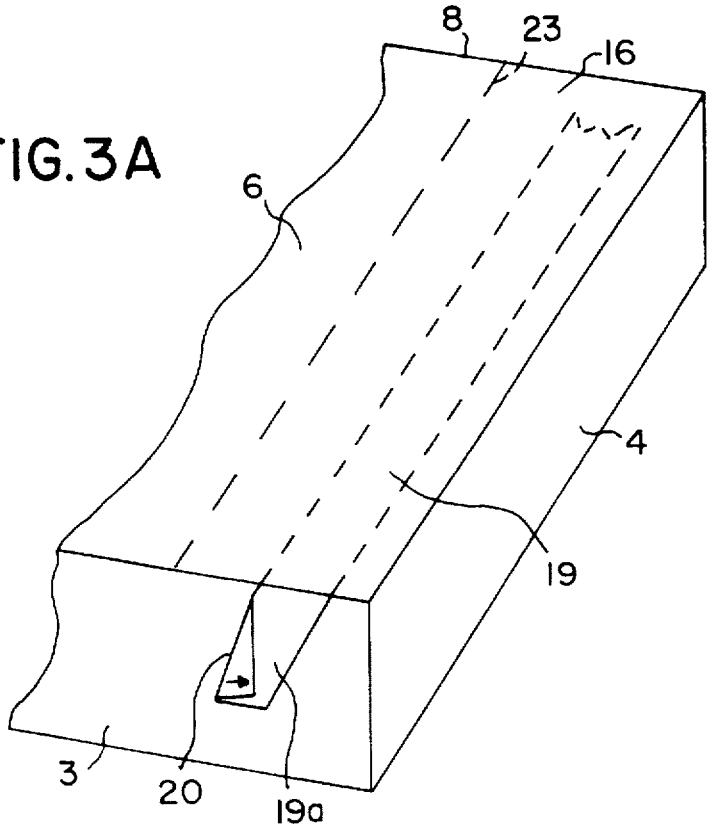
FIGS. 3*a* and 3*b*: in perspective, two detail views of the folding box with prefolded paste strips.
Figure 3B:
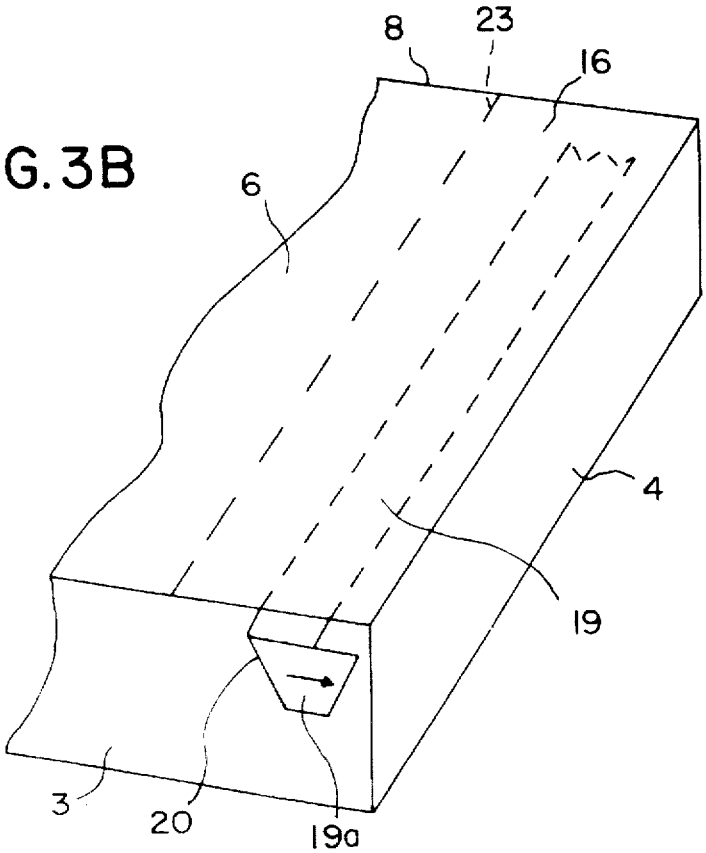

The covering strips 19 are pulled off from the adhesive strips 17 with the cover 6 closed, preferably in such a way that the protective strips 19 are twisted upward and in each case pulled away over themselves from the folding box outward. This manner of pulling out the covering strips 19 can be facilitated particularly in that the tabs 19*a* of the protective strips 19 protrude in sufficient length from the folding box and in this length, a suitable crease 20 is prefolded that indicates the pulling-off motion. Two forms of construction of such a tab 19*a* provided with a crease are shown in FIGS. 3*a* and 3*b* in detail drawings of the folding box according to FIG. 2.

The cover's 6 side areas 16 situated over the dust flaps 14, 15 are separated from the cover's middle section by perforation lines 23. This facilitates the opening of the box because in doing so, the adhesive connection at the paste strips 19 does not need to be undone, but rather only the middle section of the cover 6 is separated from the side sections 16 along the perforation lines 23.

Figure 4:
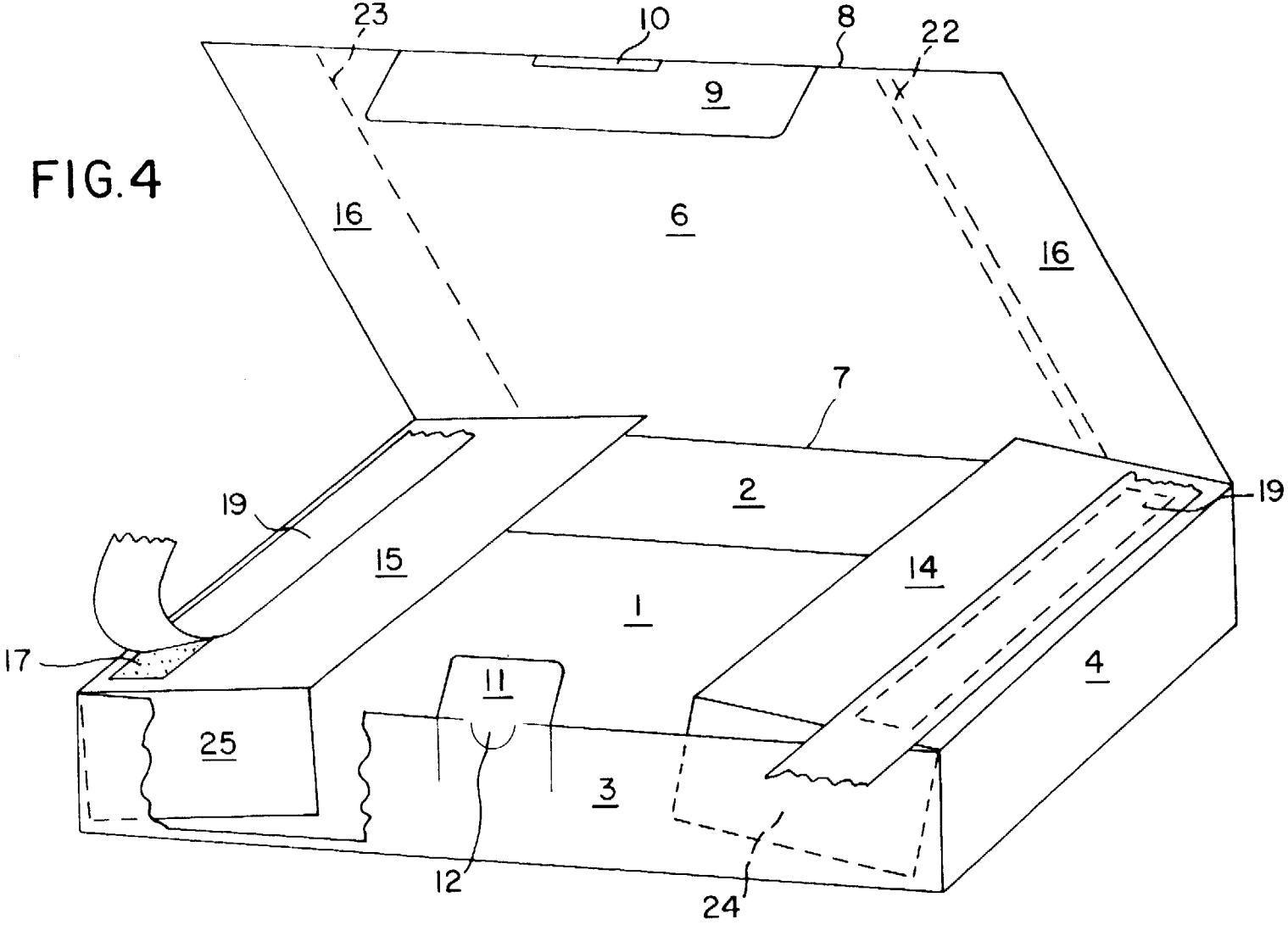
FIG. 4 a further form of construction of the folding box.

In this connection, each perforation line 23 can preferably also be formed as double perforation line on both sides of a tear strip 22 that makes possible a comfortable, reliable separation of the cover's middle section from the cover's side areas 16. Such a tear strip 22 is shown in FIG. 4 only in the right section of the cover 6, but of course will also accordingly be formed in the left section of the cover 6. In addition, with the cover closed but not yet glued on, the side sections 16 of the cover can easily be placed, along the perforation lines 23, somewhat at an angle to the cover's 6 middle section to facilitate the pulling out of the covering strips 19 under the cover 6.

A further form of construction of a folding box according to the invention is shown in FIG. 4. In this form of construction, the dust flaps 14, 15 that can be folded in are extended from the side walls 4, 5 toward the middle of the folding box in each case far enough that in closed condition, the perforation lines 23 and/or the tear strips 22 are lying on the folded-in dust flaps 14, 15 and the folded-in dust flaps 14, 15 at least partially overlap the cover's 6 middle section delimited by the perforation lines 22, 23. In addition, on each of the dust flaps' 14, 15 free edges away from the folding line 7, additional flaps 24, 25 90° offset downward are provided to prevent, when the cover is glued on, a gap through which the folding box's contents can be looked at or removed, from being opened and created between the dust flaps 14, 15 and the upper edge of the front side wall 3 by lifting the cover 6 and thereby the dust flaps 14 or 15.

Furthermore, the 90° offset tongue 9 is extended along the cover's 6 free edge 8 parallel to the folding line 7 in such a way that in closed condition, the tongue at least partially overlaps the flaps 24, 25, 90° offset downward, of the folded-in dust flaps 14, 15. An all around sealing of the folding box is thereby ensured, and a look into the folding box's contents or a removal is impossible without visible damage to the folding box.

The invention is not limited to the details of the form of construction shown. For example, the contact adhesive strips 17 with covering strips 19 can also be provided on the bottom of the cover 6 instead of on the dust flaps 14, 15. The flaps, and thereby also the adhesive strips for connecting the flaps with the cover, can also be attached on other side walls, e.g., on the front side wall 3.

In addition, the terms contact adhesive strip and cover strip as used in the description and claims are not to be construed narrowly so as to be limited to an elongate strip form. Rather, the contact adhesive may be provided on the dust flap or the cover over one or more surface areas of any appropriate shape, such as a square, a circle, a plurality of dots etc., and may be covered by a peelable cover film of any shape, provided this has a tab portion projecting over the closed cover of the box, as described above.

I claim:

1. Folding box with cover (6) and at least one folding flap (14, 15) situated under the cover, whereby the cover (6) or the flap (14, 15) is provided with a contact adhesive strip (17) and, over it, a covering strip (19) that can be pulled off, in such a way that after pulling off the covering strip (19), the cover (6) can be stuck to the flap (14, 15) by pressing, characterized in that at one of its free edges the cover (6) can be locked in the sealing position by mechanical locking (10, 11), and that the or each covering strip (19) has a tab (19*a*) which, with the cover (6) locked in sealing position, protrudes over the cover in such a way that the covering strip can be pulled out under the cover (6) in sealing position by pulling on the tab (19*a*).

2. Folding box according to claim 1, characterized in that the locking (10, 11) of the cover (6) is provided for on the folding box's side wall (3) opposite its folding edge (7), and that on both side walls (4, 5) perpendicular to the folding line (7) of the cover (6), flaps (14, 15) that can be folded in, with adhesive strips (17) and covering strips (19), are provided.

3. Folding box according to claim 1, characterized in that the cover's (6) areas (16) overlapping the flaps (14, 15) that can be folded in, are connected via perforation lines (23) with the rest of the cover (6).

4. Folding box according to claim 3, characterized in that the perforation lines (23) are designed as tear strips (22).

5. Folding box according to claim 1, characterized in that in the formed tab (19*a*) of the or each covering strip (19), a crease (20) is prefolded that facilitates the pulling-off motion of the covering strip (19) from the adhesive strip (17).

6. Folding box according to claim 3, characterized in that at least one of the flaps (14, 15) that can be folded in extends outward from the side walls (4, 5) far enough that in closed condition, the flap at least partially overlaps the cover's (6) middle section delimited by the perforation lines (22, 23).

7. Folding box according to claim 1, characterized in that at least one of the flaps that can be folded in (14, 15) has, on its free edge adjacent to the front side wall (3), a flap (24, 25) 90° offset downward that lies against the inside of the front side wall.

8. Folding box according to claim 7, characterized in that the 90° offset tongue (9) extends along the cover's (6) free edge (8) parallel to the folding line (7) far enough that in closed condition, it overlaps at least one of the flaps (14, 15) that can be folded in and/or that flap's 90° offset flap (24, 25).

9. Method for sealing a folding box that has a cover (6), at least one flap (14, 15) that can be folded in under the cover, and at least one contact adhesive strip (17) with covering strip (19) that can be pulled off, for gluing the cover (6) together with the flap (14, 15), characterized by the following succession of steps:

folding in of the at least one flap (14, 15);

folding of the cover (6) into its sealing position and mechanical locking of the cover in the sealing position;

grasping of a tab (19*a*), protruding over the cover (6), of the covering strip (19) and pulling of the covering strip (19) out of the seam between the cover (6) and the flap (14, 15) and simultaneous or subsequent pressing of the cover (6) against the flap (14, 15) in the area of the adhesive strip (17) exposed by pulling off the covering strip (19).

* * * * *